US010197058B2

(12) United States Patent
Desiron

(10) Patent No.: US 10,197,058 B2
(45) **Date of Patent: *Feb. 5, 2019**

(54) SCREW COMPRESSOR

(71) Applicant: ATLAS COPCO AIRPOWER, NAAMLOZE VENNOOTSCHAP, Wilrijk (BE)

(72) Inventor: Andries Jan F. Desiron, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 0 days.

This patent is subject to a terminal disclaimer.

(21) Appl. No.: 15/814,632

(22) Filed: Nov. 16, 2017

(65) Prior Publication Data

US 2018/0172002 A1 Jun. 21, 2018

Related U.S. Application Data

(63) Continuation of application No. 14/380,507, filed as application No. PCT/IB2012/000033 on Jun. 27, 2012, now Pat. No. 9,850,896.

(30) Foreign Application Priority Data

Feb. 28, 2012 (BE) ..... 2012/0118

(51) Int. Cl.
*F04C 18/16* (2006.01)
*F04C 23/00* (2006.01)
(Continued)

(52) U.S. Cl.
CPC ..... *F04C 18/16* (2013.01); *F04C 2/16* (2013.01); *F04C 23/008* (2013.01); *F04C 23/02* (2013.01); *F04C 28/06* (2013.01); *F04C 29/045* (2013.01)

(58) Field of Classification Search
CPC ..... F04C 18/16; F04C 23/008; F04C 29/042; F04C 29/045; F04C 29/02; F04C 29/028
(Continued)

(56) References Cited

U.S. PATENT DOCUMENTS 3,495,887 A 2/1970 Hay
3,558,248 A 1/1971 Parker
(Continued)

FOREIGN PATENT DOCUMENTS

BE 1014301 A3 8/2003
CA 1034932 A 7/1978
(Continued)

OTHER PUBLICATIONS

Final Office Action in U.S. Appl. No. 14/380,462 dated Jun. 23, 2017.

(Continued)

*Primary Examiner* — Peter J Bertheaud
(74) *Attorney, Agent, or Firm* — Bacon & Thomas, PLLC

(57) ABSTRACT

Screw compressor with a compression chamber that is formed by a compression housing, in which a pair of meshed helical compressor rotors in the form of a screw are rotatably mounted and with a drive motor that is provided with a motor chamber formed by a motor housing, in which a motor shaft is rotatably mounted. The motor shaft drives at least one of the aforementioned two compressor rotors, where the compression housing and the motor housing are connected directly together to form a compressor housing, where the motor chamber and the compression chamber are not sealed off from one another and where the rotor shafts of the compressor rotors, as well as the motor shaft, extend along axial directions that are oblique or transverse to the horizontal plane.

18 Claims, 2 Drawing Sheets

(51) Int. Cl.

| | |
|---|---|
| ***F04C 29/04*** | (2006.01) |
| ***F04C 28/06*** | (2006.01) |
| ***F04C 2/16*** | (2006.01) |
| ***F04C 23/02*** | (2006.01) |

(58) Field of Classification Search
USPC ..... 417/366, 367, 410.4, 902
See application file for complete search history.

(56) References Cited

U.S. PATENT DOCUMENTS

| | | | |
|---|---|---|---|
| 3,788,776 | A | 1/1974 | Post et al. |
| 3,790,309 | A | 2/1974 | Volz |
| 3,922,114 | A | 11/1975 | Hamilton |
| 4,063,855 | A | 12/1977 | Paul |
| 4,180,986 | A | 1/1980 | Shaw |
| 4,291,547 | A | 9/1981 | Leo |
| 4,547,135 | A | 10/1985 | Noel |
| 4,878,820 | A | 11/1989 | Doi et al. |
| 5,222,874 | A | 6/1993 | Unnewehr et al. |
| 5,246,349 | A | 9/1993 | Hartog |
| 5,531,571 | A | 7/1996 | Van Dyck |
| 5,697,763 | A | 12/1997 | Kitchener |
| 5,797,980 | A | 8/1998 | Fillet |
| 6,364,645 | B1 | 4/2002 | Dieterich |
| 6,595,761 | B2 | 7/2003 | Otsuka |
| 6,652,250 | B2 | 11/2003 | Yoshimura |
| 7,052,252 | B2 | 5/2006 | Hunsberger |
| 7,316,546 | B2 | 1/2008 | Daniels et al. |
| 8,226,378 | B2 | 7/2012 | Daniels |
| 9,850,896 | B2 * | 12/2017 | Desiron ..... F04C 18/16 |
| 2001/0046443 | A1 | 11/2001 | Van de Putte |
| 2002/0168280 | A1 | 11/2002 | Zhong |
| 2004/0146414 | A1 | 7/2004 | Nichol |
| 2004/0151602 | A1 | 8/2004 | Daniels et al. |
| 2005/0089432 | A1 | 4/2005 | Truyens et al. |
| 2007/0207045 | A1 | 9/2007 | Sundstrom et al. |
| 2007/0241627 | A1 | 10/2007 | Kharsa |
| 2010/0247361 | A1 | 9/2010 | Nemit, Jr. et al. |
| 2010/0254845 | A1 | 10/2010 | Nemit, Jr. |

FOREIGN PATENT DOCUMENTS

| | | | |
|---|---|---|---|
| CN | 101440813 | A | 5/2009 |
| CN | 201827074 | U | 5/2011 |
| DE | 2329799 | A1 | 2/1974 |
| DE | 2715610 | A1 | 10/1977 |
| EP | 0538973 | A1 | 4/1993 |
| EP | 0629778 | A2 | 12/1994 |
| EP | 1128067 | A1 | 8/2001 |
| JP | S54-154813 | A | 12/1979 |
| JP | S59-215986 | A | 12/1984 |
| JP | H11351168 | A | 12/1999 |
| WO | 03/008808 | A1 | 1/2003 |
| WO | 03/019010 | A1 | 3/2003 |
| WO | 2005-038258 | A1 | 4/2005 |
| WO | 2008/014433 | A1 | 1/2008 |

OTHER PUBLICATIONS

Russian Office Action dated Jan. 29, 2016, for RU 2014138930, and English translation thereof.
European Third Party Observations dated Aug. 19, 2016, for EP 12758989.3.
European Third Party Observations dated Jan. 17, 2017, for EP 12758989.3.
International Search Report (ISR) dated Nov. 13, 2012, for PCT/BE2012/000032.
Chinese Office Action dated Dec. 3, 2015, for CN 201280070799.0, and English translation thereof.
European Third Party Observations dated Aug. 19, 2016, for EP 12743354.8.
International Search Report (ISR) dated Dec. 5, 2012, for PCT/BE2012/000033.
Office Action in related U.S. Appl. No. 14/380,462, dated Feb. 23, 2018.

* cited by examiner

SCREW COMPRESSOR

BACKGROUND OF THE INVENTION

The present invention relates to a screw compressor.

More specifically the present invention relates to a screw compressor that at least comprises a compression chamber that is formed by a compression housing, in which a pair of meshed helical compressor rotors are rotatably mounted, which have rotor shafts that extend along a first and second axial direction that are parallel to one another, whereby the screw compressor also contains a least a drive motor, and which is provided with a motor chamber formed by a motor housing in which a motor shaft is rotatably mounted, and this motor shaft extends along a third axial direction and which drives at least one of the aforementioned two helical compressor rotors.

Such screw compressors are already known, which however present a number of disadvantages or which are open to improvement.

In order to be able to drive the compressor rotors, in the known screw compressors generally the motor shaft of the drive motor is directly or indirectly, for example via a drive belt or a gearwheel transmission, coupled to the rotor shaft of one of the compressor rotors.

Hereby the rotor shaft of the compressor concerned must be adequately sealed, which is far from easy.

Indeed, a certain pressure supplied by the screw compressor prevails in the compression housing, which has to be screened off from the compressor sections that are not under this pressure or from the ambient pressure.

For such applications, a "contact seal" is often used.

The rotor shaft of the compressor rotor concerned however turns at very high speeds, such that such a type of seal brings about enormous power losses during the operation of the screw compressor, resulting in a reduced efficiency of the screw compressor.

Moreover, such a "contact seal" is subject to wear, and if it is not carefully installed such a "contact seal" is very sensitive to the occurrence of leaks.

Another aspect of the known screw compressors of the type described above that is open to improvement, is that both the drive motor and the screw compressor have to be provided with lubrication and cooling, that generally consist of separate systems and thus are not attuned to one another, require a number of different types of lubricants and/or coolants, and are thereby complicated or expensive.

In addition, in such known screw compressors with separate cooling systems for the drive motor and compressor rotors, the possibilities for recovering the lost heat stored in the coolants in an optimum way are not fully utilised.

SUMMARY OF THE INVENTION

The purpose of the invention is thus to provide a solution to one or more of the foregoing disadvantages and any other disadvantages.

More particularly, it is an objective of the invention to offer a screw compressor that is robust and simple, whereby the risk of wear and leaks are kept to a minimum, whereby the lubrication of bearings and the cooling of components is realised by very simple means and whereby improved recovery of the heat losses occurring can be achieved.

To this end the invention concerns a screw compressor whereby the compression housing and the motor housing are connected directly to one another to form a compressor housing, whereby the motor chamber and compression chamber are not sealed off from one another and whereby the screw compressor is a vertical screw compressor whereby the rotor shafts of the compressor rotors as well as the motor shaft extend along axial directions that are at an angle with or transverse to the horizontal plane during normal operation of the screw compressor.

A first big advantage of such a screw compressor according to the invention is that the compressor housing forms a whole, consisting of a compression housing and motor housing that are directly attached to one another, so that the drive means of the compressor rotors, in the form of a drive motor, are integrated directly in the screw compressor.

It should be noted here that the compression chamber and the motor chamber do not have to be sealed off from one another, as due to the direct installation of the motor housing and compression housing together, the motor shaft and one of the compressor rotors can be coupled completely within the contours of the compressor housing, without having to pass through a section that is at a different pressure, such as is usual in the known screw compressors, for example, whereby the motor shaft is coupled to a compressor rotor, whereby a section of the coupling is exposed to the ambient pressure.

The characteristic that such a seal between the compression chamber and the motor chamber is not necessary, constitutes a considerable advantage of a screw compressor according to the invention, as a higher energy efficiency of the screw compressor is obtained than with the known screw compressors, and no wear of such a seal is possible and leaks as a result of the poor installation of such a seal are avoided.

Another advantage of such a screw compressor according to the invention, whereby the motor chamber and the compression chamber form a closed whole, is that no external air cooling is required, so that the screw compressor can be better insulated with respect to the environment on a thermal level, and certainly also on an acoustic level, such that the noise generated by the screw compressor can be greatly reduced compared to the existing screw compressors.

Through better thermal insulation of the screw compressor, sensitive electronic components installed in the vicinity of the screw compressor are more easily or better shielded against the heat produced by the screw compressor.

Another very important aspect of a screw compressor according to the invention is that the same lubricants and coolants can be used in a very simple way for both the drive motor and the compressor rotors, as the motor chamber and the compression chamber are not separated from one another by a seal.

According to a preferred embodiment of a screw compressor according to the invention, the screw compressor is preferably provided with a fluid, for example an oil, with which both the drive motor and the compressor rotors are cooled and/or lubricated.

Thus the design of the screw compressor according to the invention is greatly simplified, fewer different coolants and/or different lubricants are needed, and the whole can thus be constructed more cheaply.

Moreover, it is the case that by having a fluid circulate during a single cycle both along the drive motor and along the compressor elements to cool the screw compressor, this fluid undergoes a greater temperature change than when separate cooling systems are used for the drive motor and the compressor rotors.

Indeed, this fluid will absorb heat from both the drive motor and the compressor elements instead of just heat from one of the two components.

A consequence of this is that the heat stored in the fluid can be more easily recovered than when the fluid only undergoes a small temperature change.

However, account must be taken of the fact that a different operating temperature will have to be chosen for the drive motor or the compressor rotors.

Another advantage of a screw compressor according to the invention is due to its characteristic that the rotor shafts of the compressor rotors, as well as the motor shaft, in normal operation of the screw compressor extend along axial directions that are oblique or transverse to the horizontal plane.

Indeed, such an oblique position of the shafts with respect to the horizontal plane stimulates a good flow of the lubricants and/or coolants, as in principle they can flow over the drive motor and the compressor rotors under the influence of gravity, without additional means or additional energy being required for this purpose.

According to a preferred embodiment of the screw compressor according to the invention, the screw compressor is preferably a vertical screw compressor, whereby in this case the rotor shafts of the compressor rotors, as well as the motor shaft, in normal operation of the screw compressor extend along axial directions that are vertical.

As a result the effect of gravity can of course be reinforced, as a least insofar the channels for lubricants and coolants also extend vertically.

BRIEF DESCRIPTION OF THE DRAWINGS

With the intention of better showing the characteristics of the invention, a preferred embodiment of a screw compressor according to the invention is described hereinafter by way of an example, without any limiting nature, with reference to the accompanying drawings, wherein.

DETAILED DESCRIPTION OF THE INVENTION

Figure 1:
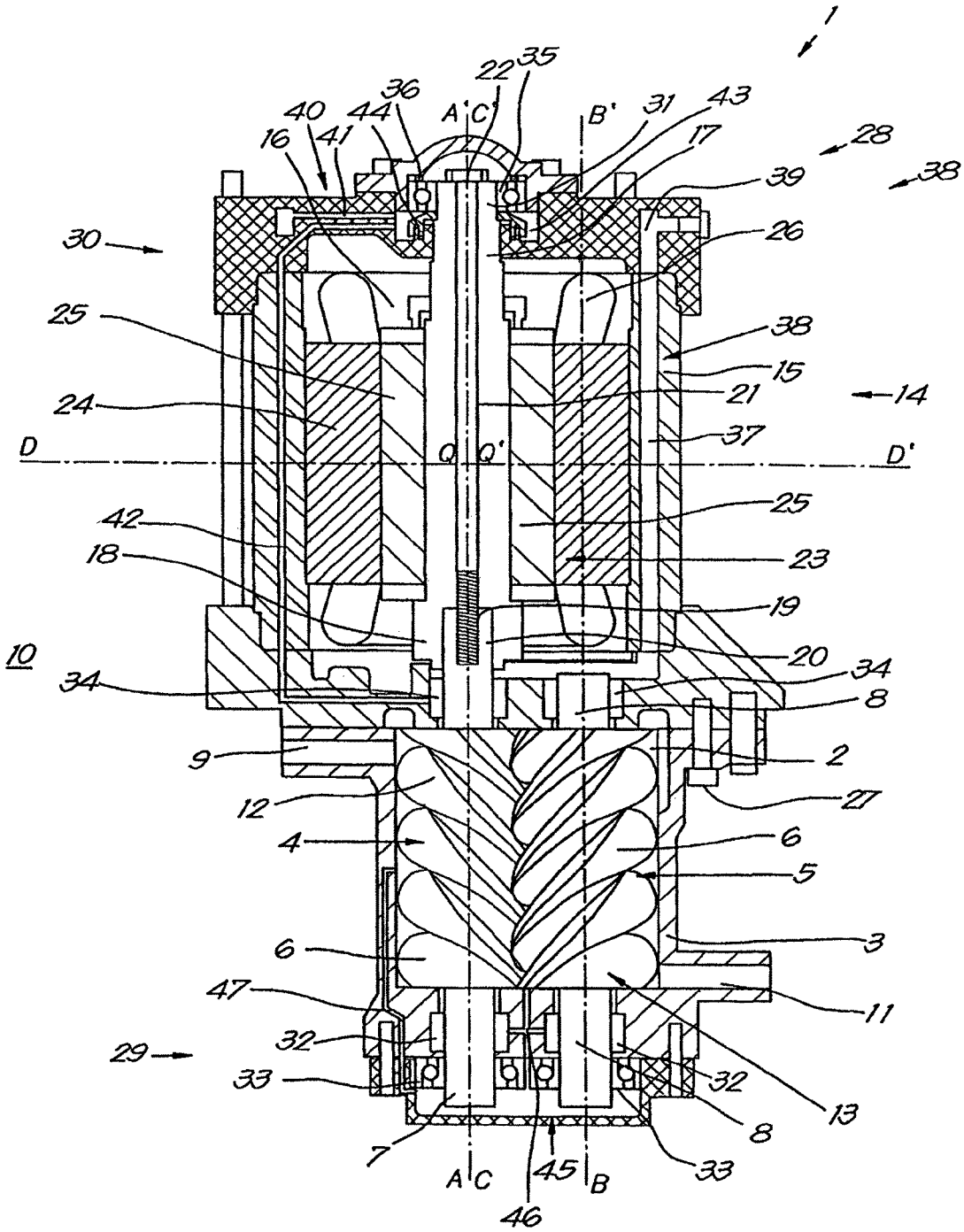
FIG. 1 schematically shows a screw compressor according to the invention; and, FIG. 2 schematically shows an assembly to illustrate the use of such a screw compressor according to the invention.

The screw compressor 1 according to the invention shown in FIG. 1 first and foremost contains a compression chamber 2 that is formed by a compression housing 3.

In the compression chamber 2 a pair of meshed helical compressor rotors are rotatably mounted, more specifically a first helical compressor rotor 4 and a second helical compressor rotor 5.

These helical compressor rotors 4 and 5 have a helical profile 6 that is affixed around a rotor shaft of the compressor rotor 4 and 5 concerned, respectively rotor shaft 7 and rotor shaft 8.

Hereby the rotor shaft 7 extends along a first axial direction AA', while the rotor shaft 8 extends along a second axial direction BB'.

Moreover, the first axial direction AA' and the second axial direction BB' are parallel to one another.

Moreover, there is an inlet 9 through the walls of the compression housing 3 up to the compression chamber 2 for drawing in air, for example air from the surrounds 10 or originating from a previous compressor stage, as well as an outlet 11 for the removal of compressed air, for example to a compressed air consumer or a subsequent compressor stage.

The compression chamber 2 of the screw compressor 1 is, as is known, formed by the inside walls of the compression housing 3, which have a form that closely fit the external contours of the pair of helical compressor rotors 4 and 5 in order to drive the air drawn in via the inlet 9, during the rotation of the compressor rotors 4 and 5, between the helical profile 6 and the inside walls of the compression housing 3 in the direction of the outlet 11, and thus to compress the air, and to build up pressure in the compression chamber 2.

The direction of rotation of the compressor rotors 4 and 5 determines the drive direction and thus also determines which of the passages 9 and 11 will act as the inlet 9 or the outlet 11.

The inlet 9 is hereby at the low pressure end 12 of the compressor rotors 4 and 5, while the outlet 11 is near the high pressure end 13 of the compressor rotors 4 and 5.

Moreover, the screw compressor is provided with a drive motor 14.

This drive motor 14 is provided with a motor housing 15 that is affixed above the compression housing 3 and whose inside walls enclose a motor chamber 16.

In the motor chamber 16, a motor shaft 17 of the drive motor 14 is rotatably mounted, and in the embodiment shown this motor shaft 17 is directly coupled to the first helical compressor rotor 4 in order to drive it, but this does not necessarily need to be the case.

The motor shaft 17 extends along a third axial direction CC', which in this case also coincides with the axial direction AA' of the rotor shaft 7, so that the motor shaft 17 is in line with the compressor rotor 4 concerned.

To couple the motor shaft 17 to the compressor rotor 4, one end 18 of the motor shaft 17 is provided with a cylindrical recess 19 in which the end 20 of the rotor shaft 7, that is located close to a low pressure end 12 of the compressor rotor 4, can be suitably inserted.

Moreover, the motor shaft 17 is provided with a passage 21 in which a bolt 22 is affixed, which is screwed into an internal screw thread provided in the aforementioned end 20 of the rotor shaft 7.

Of course there are many other ways of coupling the motor shaft 17 to the rotor shaft 7, which are not excluded from the invention.

Alternatively it is indeed not excluded that a screw compressor 1 according to the invention is constructed such that the motor shaft 17 also forms the rotor shaft 7 of one of the compressor rotors 4, by constructing the motor shaft and rotor shaft 7 as a single piece, such that no coupling means are needed for coupling the motor shaft 17 and rotor shaft 7.

Moreover, in the example shown in FIG. 1, the drive motor 14 is an electric motor 14 with a motor rotor 23 and motor stator 24, whereby more specifically in the example shown the motor rotor 23 of the electric motor 14 is equipped with permanent magnets 25 to generate a rotor field, while the motor stator 24 is equipped with electrical windings 26 to generate a stator field that is switched and acts in a known way on the rotor field in order to bring about a rotation of the motor rotor 23, but other types of drive motors 14 are not excluded according to the invention.

According to a preferred embodiment of a screw compressor 1 according to the invention, the electric motor 14 is a synchronous motor 14.

It is highly characteristic of the invention that the compression housing 3 and the motor housing 15 are connected directly together, in this case by bolts 27, to form a compressor housing 28 of the screw compressor 1, whereby more specifically the motor chamber 16 and the compression chamber 2 are not sealed off from one another.

In the example shown the compression housing 3 and the motor housing 15 are actually constructed as separate parts of the compressor housing 28, that more or less correspond to the parts of the screw compressor 1 that respectively contain the drive motor 14 and the compressor rotors 4 and 5.

However, attention is drawn here to the fact that the motor housing 15 and the compression housing 3 do not necessarily have to be constructed as such separate parts, but just as well can be constructed as a single whole.

As an alternative it is not excluded that the compressor housing 28 is constructed from more or fewer parts, that entirely or partially contain the compressor rotors 4 and 5 or the drive motor 14 or all these components together.

It is essential for the invention that, in contrast to what is the case with known screw compressors, no seal is used that separates the motor chamber 16 and the compression chamber 2 from one another, which for this reason alone, as explained in the introduction, is a considerable advantage of a screw compressor 1 according to the invention, on account of the lower energy losses, less wear and lower risk of leaks.

In order to be able to control the electric drive motor 14 without problems, without having to use sensors that are exposed to the high pressures present in the set formed by the motor chamber 2 and the compressor chamber 16, the inductance of the electric motor 14 along the direct axis DD', whereby the direction DD' of this direct axis corresponds to the primary direction DD' of the rotor field, is sufficiently different to the inductance of the electric motor 14 along an axis QQ' perpendicular to it, more specifically the quadrature axis QQ'.

Preferably these inductances of the electric motor 14 according to the aforementioned direct axis DD' and the quadrature axis QQ' are different enough such that the position of the motor rotor 23 in the motor stator 24 can be determined by measuring the aforementioned inductance difference in the vicinity outside the compressor housing 28.

According to the invention the drive motor 14 must of course also be of a type that can withstand the compressor pressure.

A practical problem that must be solved with such drive motors 14 is to do with the electrical connections of the drive motor 14, and more specifically the transit holes for the electric cables from the outside, where atmospheric pressures prevail, through the motor housing 15 to the motor chamber 16, which in a screw compressor 1 according to the invention is under compressor pressure, which of course is not a simple problem.

To realise such an electrical connection of the drive motor 14, according to the invention use can be made of a connection in which a glass-to-metal seal is applied.

Metal pins are embedded in the openings in the motor housing 15, more specifically by sealing them off in the openings with a glass substance that is melted in around the pins.

Then the electric cables concerned can be connected to both ends of the pins.

Furthermore the drive motor 14 is preferably of a type that can generate a sufficiently large start-up torque in order to start the screw compressor 1 when the compression chamber 2 is under compressor pressure, whereby the release of compressed air when the screw compressor 1 is stopped can be avoided.

The fact that the compression chamber 2 and the motor chamber 16 and the compression chamber 1 form a closed whole, in combination with another characteristic of a screw compressor 1 according to the invention, more specifically that the screw compressor 1 is not a horizontal, but preferably a vertical screw compressor 1, yields other important technical advantages, as will be demonstrated hereinafter.

A vertical screw compressor 1 here means that the rotor shafts 7 and 8 of the compressor rotors 4 and 5, as well as the motor shaft 17 of the drive motor 14, during normal operation of the screw compressor 1 extend along axial directions AA', BB' and CC' that are vertical.

However, according to the invention it is not excluded that the perfect vertical position can be departed from, for example by applying an oblique non-horizontal position.

According to an even more preferred embodiment of a screw compressor 1 according to the invention, the compression housing 2 hereby forms a base 29 or bottom part of the entire compressor housing 28 of the screw compressor 1, while the motor housing 15 forms a head 30 or top part of the compressor housing 28.

Furthermore, the low pressure ends 12 of the compressor rotors 4 and 5 are preferably the ends 12 that are the closest to the head 30 of the compressor housing 29, and the high pressure ends 13 of the compressor rotors 4 and 5 are the ends 13 that are the closest to the base 29 of the compressor housing 28, so that the inlet 12 for drawing in air and the low pressure side of the screw compressor 1 are higher than the outlet 13 for removing compressed air.

This configuration is particularly useful to obtain efficient cooling and lubrication of the drive motor 14 and compressor rotors 4 and 5, and also to maintain operational reliability without additional means, when the screw compressor 1 is stopped, more specifically because the coolant and lubricant present can flow out under the effect of gravity.

The components of the screw compressor 1 that certainly must be lubricated and cooled are of course the components that rotate, more specifically the compressor rotors 4 and 5, the motor shaft 17, as well as the bearings with which these components are supported in the compressor housing 28.

A useful bearing arrangement is also shown in FIG. 1, as it enables the motor shaft 17 and the rotor shaft 7 and/or rotor shaft 8 to be constructed with a limited cross-section, or at least with a smaller cross-section than is generally the case with the known screw compressors of a similar type.

In this case the rotor shafts 7 and 8 are hereby supported at both ends 12 and 13 by a bearing, while the motor shaft 17 is also supported by bearings at its end 31 on the head side of the compressor housing 28.

More specifically, the compressor rotors 4 and 5 are supported axially and radially in the compressor housing 28 by bearings at their high pressure end 13, by means of a number of outlet bearings 32 and 33, in this case respectively a cylindrical bearing or needle bearing 32 in combination with a deep groove ball bearing 33.

On the other hand, at their low pressure end 12 the compressor rotors 4 and 5 are only radially supported in the compressor housing 28 by bearings, by means of an inlet bearing 34, which in this case is also a cylindrical bearing or needle bearing 34.

Finally, at the end 31 opposite the driven compressor rotor 4, the motor shaft 17 is supported axially and radially in the compressor housing 28 by bearings, by means of a motor bearing 35, which in this case is a deep groove ball bearing 35.

Tensioning means 36 are hereby provided at the end 31, in the form of a spring element 36, and more specifically a cupped spring washer 36, whereby these tensioning means 36 are intended to exert an axial pre-load on the motor bearing 35, and this pre-load is oriented along the axial direction CC' of the motor shaft 17 in the direction against the force generated by the meshed helical compressor rotors 4 and 5, so that the axial bearing at the high pressure end of the compressor rotors 4 and 5 are somewhat relieved.

Of course many other bearing arrangements for supporting the rotor shafts 7 and 8 and the motor shaft 17, realised with all kinds of different bearings, are not excluded from the invention.

For cooling and lubricating the screw compressor 1, the screw compressor 1 according to the invention is preferably provided with a fluid 37, for example an oil, with which both the drive motor 14 and the compressor rotors 4 and 5 are cooled or lubricated, and preferably both the cooling function and the lubricating function are fulfilled by the same fluid 37.

Furthermore, a screw compressor 1 according to the invention is equipped with a cooling circuit 38 for cooling both the drive motor 14 and the screw compressor 1 and through which fluid 37 can flow from the head 30 of the compressor housing 28 to the base 29 of the compressor housing 28.

In the example shown this cooling circuit 38 consists of cooling channels 39 that are provided in the motor housing 15 and of the compression chamber 2 itself.

The cooling channels 39 ensure that the fluid 37 does not get into the air gap between the motor rotor 23 and the motor stator 24, which would give rise to energy losses and similar.

In the example shown, the majority of the cooling channels are oriented axially and some parts of the cooling channels 39 are also concentric to the axis AA', but the orientation of these cooling channels 39 does not play much of a role, as long as a good flow of the fluid 37 is assured.

According to the invention it is the intention here that the fluid 37 is driven through the cooling channels 39 under a compressor pressure generated by the screw compressor 1 itself, as will be explained hereinafter on the basis of FIG. 2.

Thus a sufficiently large flow of fluid 37 can be obtained through the cooling channels 39, which is necessary in view of the considerable heat generated in the screw compressor 1.

On the other hand the screw compressor 1 is also provided with a lubrication circuit 40 for lubricating the motor bearing 35 as well as the inlet bearings 34.

This lubrication circuit 40 in this case consists of one or more branches 41 to the cooling channels 39 in the motor housing 15 for the supply of fluid 37 to the motor bearing 35, and of outlet channels 42 for removing fluid 37 from the motor bearing 35 up to the inlet bearings 34, from where the fluid 37 can flow in the compression chamber 2.

In this way the fluid 37 can easily flow from the motor bearing 35 to the inlet bearings 34, from where the fluid 37 can further freely flow over the compressor rotors 4 and 5.

In the example shown the branches 41 primarily extend in a radial direction, but again this is not necessarily the case according to the invention.

Moreover the branches 41 have a diameter that is substantially smaller than the diameter of the cooling channels 39, such that only a small amount of fluid flows through the lubrication circuit 40 compared to the amount of fluid 37 that flows through the cooling circuit 38 for the cooling.

It is hereby the intention that the flow of fluid 37 in the lubrication circuit 40, and certainly in the axially extending outlet channels 42, primarily takes place under the effect of gravity, and only to a small extent as a result of a compressor pressure generated by the screw compressor 1, so that when the screw compressor 1 is stopped the fluid 37 can flow out and does not accumulate.

Another advantageous characteristic is that a reservoir 43 is provided under the motor bearing 35 to receive the fluid 37, to which the branches 41 and the outlet channels 42 are connected.

Moreover, the reservoir 43 is hereby preferably sealed from the motor shaft 17 by means of a labyrinth seal 44.

Another aspect of a screw compressor 1 according to the invention is that a lubrication circuit 45 is provided in the base 29 to lubricate the outlet bearings 32 and 33.

This lubrication circuit 45 consists of one or more supply channels 46 for the supply of fluid 37 from the compression chamber 2 to the outlet bearings 32 and 33, as well as one or more outlet channels 47 for the return of fluid 37 from the outlet bearings 32 and 33 to the compression chamber 2. Hereby it is advantageous for the outlet channels 47 to lead to the compression chamber 2 above the entrance of the supply channels 46 in order to obtain the necessary pressure difference for a smooth flow of fluid 37 through the lubrication circuit 45.

Moreover, according to the invention the motor housing 15 and/or the compressor housing 3, with their cooling channels 39, branches 41, outlet channels 42, lubrication circuit 45 and reservoir 43, are preferably produced by extrusion, as this is a very simple manufacturing process. Thus it will be understood that a very simple system is realised for lubricating the various bearings 32 to 35, as well as for cooling the drive motor 14 and the compressor rotors 4 and 5.

Figure 2:
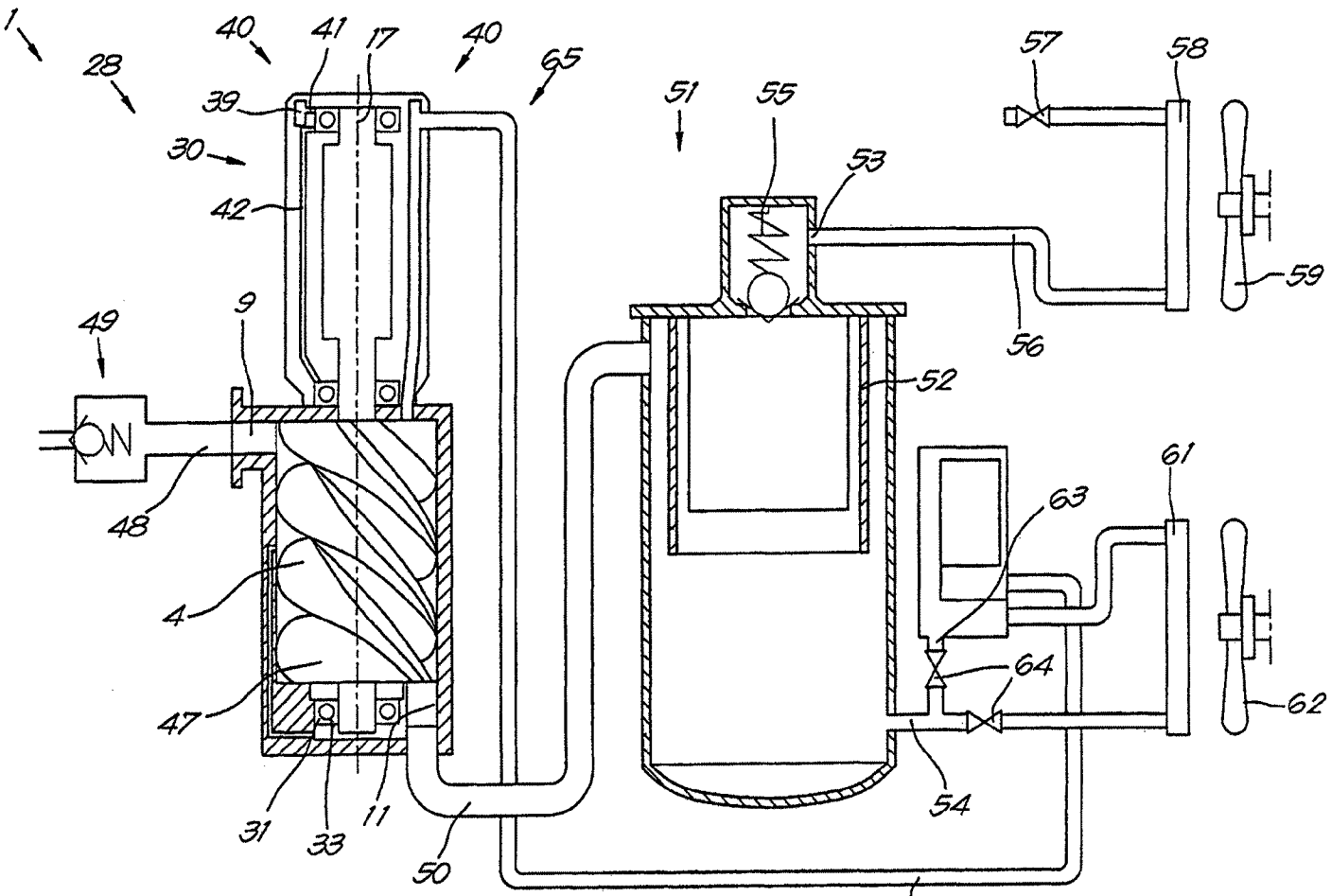

FIG. 2 shows a more practical arrangement in which a screw compressor 1 according to the invention is applied.

An inlet pipe 48 is hereby connected to the inlet 9 of the screw compressor 1 in which there is an inlet valve 49, which enables the inflow of the air supply to the screw compressor 1 to be controlled.

According to a preferred embodiment of a screw compressor 1 according to the invention, this inlet valve 49 is preferably a non-controlled or self-regulating valve, and in an even more preferred embodiment this inlet valve 49 is a non-return valve 49, which is indeed also the case in the example of FIG. 2.

An outlet pipe 50 is connected to the outlet 11 that leads to a pressure vessel 51 that is equipped with an oil separator 52.

Compressed air, mixed with fluid 37, more specifically oil 37, that acts as a lubricant and coolant, leaves the screw compressor 1 through the outlet 11, whereby the mixture in the pressure vessel 51 is separated into two flows by the oil separator 52, on the one hand an outflow of compressed air via the air outlet 53 above the pressure vessel 51, and on the other hand an outflow of fluid 37 via an oil outlet 54 at the bottom of the pressure vessel 51.

In the example shown, the air outlet 53 of the pressure vessel 51 is also equipped with a non-return valve 55.

Furthermore a consumer pipe 56, which can be closed by a tap or valve 57, is connected to the air outlet 53.

A section 58 of the consumer pipe 56 is constructed as a radiator 58 that is cooled by means of a forced airflow of surrounding air 10 originating from a fan 59, of course with the intention of cooling the compressed air.

Analogously, the oil outlet 54 is also provided with an oil return pipe 60 that is connected to the head 30 of the compressor housing 28 for the injection of oil 37.

A section 61 of the oil return pipe 60 is also constructed as a radiator 61, which is cooled by a fan 62.

A bypass pipe 63 is also provided in the oil return pipe 60 that is affixed in parallel over the section of the oil return pipe 60 with radiator 61.

Via one valve 64, the oil 37 can be sent through the section 61, in order to cool the oil 37, for example during the normal operation of the screw compressor 1, or through the bypass pipe 63 in order not to cool the oil 37, such as during the start-up of the screw compressor 1, for example.

As shown in greater detail in FIG. 2, the cooling circuit 38 and the lubrication circuit 40 are in fact connected to a return circuit 65 for the removal of fluid 37 from the outlet 11 in the base 29 of the screw compressor 1 and for returning the removed fluid 37 to the head 30 of the compressor housing 28.

In the example shown this aforementioned return circuit 65 is formed by the set consisting of the outlet pipe 50 provided at the outlet 11, the pressure vessel 51 connected to the outlet pipe 50, and the oil return pipe 60 connected to the pressure vessel 51.

Hereby, the outlet pipe 50 is connected to the base 29 of the compressor housing 28 and the oil return pipe 60 is connected to the head 30 of the compressor housing 28.

Moreover, according to the invention it is the intention that during the operation of the screw compressor 1, the fluid 37 is driven through the return circuit 65 from the base 29 to the head 30 of the compressor housing 28 as a result of a compressor pressure generated by the screw compressor 1 itself.

This is also indeed the case in the embodiment of FIG. 2, as the return circuit 65 starts from the side of the compression chamber 2 at the base 29 of the compressor housing 28, and this side of the compression chamber 2 is located at the high pressure end 13 of the compressor rotors 4 and 5.

According to a preferred embodiment of a screw compressor 1 according to the invention the outlet pipe 50 between the pressure vessel 51 and the screw compressor 1 is free of closing means in order to enable a flow through the outlet pipe 50 in both directions.

According to an even more preferred embodiment of a screw compressor 1 according to the invention, additionally the oil return pipe 60 is also free of self-regulating non-return valves.

A great advantage of such an embodiment of a screw compressor 1 according to the invention is that its valve system for closing the screw compressor 1 is much simpler than with the known screw compressors.

More specifically only an inlet valve 49 is needed to obtain a correct operation of the screw compressor 1, as well as means to close off the air outlet 53, such as for example a non-return valve 55 or a tap or valve 57.

In addition, the inlet valve 49 does not even need to be a controlled valve 49 as is usually the case, but on the contrary preferably a self-regulating non-return valve 49, as shown in FIG. 2.

Moreover, a more energy-efficient operation can be achieved even with this one valve 49.

Indeed, with a screw compressor 1 according to the invention the drive motor 14 is integrated in the compressor housing 28, whereby the motor chamber 16 and the compression chamber 2 are not sealed off from one another, so that the pressure in the pressure vessel 51 and the pressure in the compression chamber 2, as well as in the motor chamber 16 are practically equal, i.e. equal to the compressor pressure.

Consequently when the screw compressor 1 is stopped, the oil 37 present in the pressure vessel 51 will not be inclined to flow back to the screw compressor 1, and more specifically the drive motor 14, as is indeed the case with the known screw compressors whereby the pressure in the drive motor is generally the ambient pressure.

With known screw compressors, a non-return valve always has to be provided in the oil return pipe 60, which is not the case with a screw compressor according to the invention.

Analogously, with the known screw compressors a non-return valve is provided in the outlet pipe 50, in order to prevent the compressed air in the pressure vessel being able to escape via the screw compressor and the inlet when the screw compressor is stopped.

In the known screw compressors these non-return valves also constitute a significant energy loss.

With a screw compressor 1 according to the invention it is sufficient to hermitically close off the inlet 9 by means of the inlet valve 49, when the screw compressor 1 is stopped, so that both the pressure vessel 51 and the compression chamber 2 and motor chamber 16 remain under compression pressure after the screw compressor 1 has stopped.

The inlet 9 is hermetically closed using a non-return valve 49, automatically under the pressure present in the screw compressor 1 and by the elasticity in the non-return valve 49, whereby when the screw compressor 1 is stopped there is no further suction force from the air to pull the non-return valve 49 open.

This is not possible with known screw compressors, as they are always provided with a seal that separates the motor chamber and the compression chamber from one another, generally realised by means of a seal on the rotating rotor shaft 7.

Keeping the compression chamber under pressure with the known screw compressors would give rise to damage of this seal.

An advantage of the screw compressor 1 according to the invention, that is directly related to this, is that no or hardly any compressed air is lost when the screw compressor 1 is stopped.

It will be understood that this constitutes an important energy saving.

Another aspect is that the aforementioned extra non-return valves in the oil return pipe and in the outlet pipe in the known screw compressors, must be pushed open during operation such that large energy losses occur, which do not occur with a screw compressor 1 according to the invention.

The use according to the invention of a screw compressor according to the invention is also very advantageous.

It is hereby the intention that when the screw compressor 1 starts up, whereby no pressure has yet built up in the pressure vessel 51, the self-regulating inlet valve 49, which is constructed as a non-return valve 49, opens automatically through the action of the screw compressor 1 and a compression pressure is built up in the pressure vessel 51.

Then, when the screw compressor 1 is stopped, the non-return valve 55 on the pressure vessel 51 automatically closes the air outlet 53 of the pressure vessel 51, and the inlet valve 49 also automatically hermetically closes the inlet pipe 48, so that, after the screw compressor 1 has stopped, both the pressure vessel 51 and the compression chamber 2 and motor chamber 16 of the screw compressor 1 remain under compression pressure.

Thus little or no compressed air is lost.

Moreover, pressure can be built up much more quickly when restarting, which enables a more flexible use of the screw compressor 1 and also contributes to the more efficient use of energy.

When restarting the screw compressor 1, whereby there is still a compression pressure in the pressure vessel 51, the inlet valve 49 first closes automatically until the compressor rotors 4 and 5 reach a sufficiently high speed, after which the self-regulating inlet valve 49 opens automatically under the suction effect created by the rotation of the compressor rotors 4 and 5.

The present invention is by no means limited to the embodiments of a screw compressor 1 according to the invention described as an example and shown in the drawings, but a screw compressor 1 according to the invention can be realised in all kinds of variants and in different ways, without departing from the scope of the invention.

The invention claimed is:

1. A vertical screw compressor comprising:

a compression chamber, comprising an inlet and an outlet, that is formed by a compression housing in which a pair of meshed helical compressor rotors in the form of a screws are rotatably mounted; rotor shafts of said meshed helical compressor rotors extend parallel to one another along first and second rotational axes, respectively;

a non-return valve provided at the inlet of the compression chamber;

a drive motor that is provided with a motor chamber formed by a motor housing, in which a motor shaft is rotatably mounted that drives at least one of the aforementioned pair of meshed helical compressor rotors, wherein the compression housing and the motor housing are connected directly to one another to form a compressor housing, whereby the motor chamber and the compression chamber are not sealed off from one another, and wherein the rotor shafts of the compressor rotors extend at an angle with or transverse to a horizontal plane during normal operation of the vertical screw compressor, and a pressure vessel, arranged downstream and separate from the compressor housing, comprising an outlet valve;

wherein, when the vertical screw compressor is stopped, the pressure vessel, the compression chamber, and the motor chamber are configured to be able to be in fluid communication and be under a practically equal pressure such that a seal between the compression chamber and the motor chamber is not necessary.

2. The vertical screw compressor according to claim 1, wherein the motor shaft is directly coupled to one of the rotor shafts of the compressor rotors and extends along an axial direction in line with the first or second rotational axes of the rotor shaft of the compressor rotor concerned.

3. The vertical screw compressor according to claim 1, wherein the motor shaft also forms the rotor shaft of one of the compressor rotors.

4. The vertical screw compressor according to claim 1, wherein the drive motor is an electric motor with a motor rotor and a motor stator.

5. The vertical screw compressor according to claim 4, wherein the electric motor is equipped with permanent magnets to generate a magnetic field.

6. The screw compressor according to claim 4, wherein the electric motor is a synchronous motor.

7. The screw compressor according to claim 4, wherein the drive motor is of a type that can withstand the compressor pressure.

8. The screw compressor according to claim 4, wherein the drive motor is of a type that can generate a sufficiently large start-up torque to start up the screw compressor when the compression chamber is under compressor pressure.

9. The screw compressor according to claim 1, wherein the compressor rotors have a high pressure end that are supported axially and radially in the compressor housing by bearings, by means of one or more outlet bearings.

10. The screw compressor according to claim 1, wherein the compressor rotors have a low pressure end that is only supported radially in the compressor housing by one or more inlet bearings.

11. The screw compressor according to claim 1, wherein the motor shaft, at the end opposite the driven compressor rotor, is supported axially and radially in the compressor housing by means of one or more motor bearings.

12. The screw compressor according to claim 1, wherein the compression housing forms a base or bottom section of the compressor housing, and that the motor housing forms a head or top section of the compressor housing and wherein the compression chamber inlet for drawing in air is provided near a low pressure end, and wherein the low pressure end is at the ends of the compressor rotor that is closest to the head of the compressor housing, and the outlet for removing compressed air is provided near a high pressure end, and wherein the high pressure end is at the ends of the compressor rotors that are the closest to the base or bottom section of the compressor housing.

13. The screw compressor according to claim 1, wherein the screw compressor is provided with a fluid, with which both the drive motor and the compressor rotors are cooled and/or lubricated, wherein the screw compressor is provided with a cooling circuit for cooling both the drive motor and the compression chamber and through which fluid can flow from a head of the compressor housing to a base of the compressor housing, wherein the cooling circuit consists of cooling channels that are provided in the motor housing and of the compression chamber itself, wherein the cooling channels at least partially extend along an axial direction, and wherein the fluid is driven through the cooling channels under a compressor pressure generated by the screw compressor.

14. A screw compressor that at least comprises the following elements:

a compression chamber, comprising an inlet and an outlet, that is formed by a compression housing in which a pair of meshed helical compressor rotors in the form of a screws are rotatably mounted; rotor shafts of said meshed helical compressor rotors extend parallel to one another along first and second rotational axes, respectively;

a non-return valve provided at the inlet of the compression chamber;

a drive motor that is provided with a motor chamber formed by a motor housing, in which a motor shaft is rotatably mounted that drives at least one of the aforementioned pair of meshed helical compressor rotors, wherein the compression housing and the motor housing are connected directly to one another to form a compressor housing, whereby the motor chamber and the compression chamber are not sealed off from one another and whereby the screw compressor is a vertical screw compressor in which the rotor shafts of the compressor rotors as well as the motor shaft extend at an angle transverse to a horizontal plane during normal operation of the screw compressor, wherein, when the screw compressor is stopped, a pressure vessel, the compression chamber, and the motor chamber are configured to be able to be in fluid communication and remain under a substantially equal compression pressure until the screw compressor is restarted, wherein the drive motor is an electric motor with a motor rotor and a motor stator, wherein the electric motor is equipped with permanent magnets to generate a magnetic field, and wherein the position of the motor rotor is determined by measuring the difference between an inductance of the electric motor along a direct motor axis and an inductance of the electric motor along an axis perpendicular to said direct motor axis, wherein the measuring takes place at a position outside of the compressor housing.

15. A method for controlling a vertical screw compressor comprising the steps:

providing a vertical screw compressor comprising a compression chamber, including an inlet and an outlet, that is formed by a compression housing in which a pair of meshed helical compressor rotors in the form of screws are rotably mounted, rotor shafts of said meshed helical compressor rotors extending parallel to one another along first and second rotational axes, respectively, wherein a non-return valve provided at the inlet of the compression chamber, a drive motor is provided with a motor chamber formed by a motor housing, in which a motor shaft is rotatably mounted that drives at least one of the aforementioned pair of meshed helical compressor rotors, wherein the compression housing and the motor housing are connected directly to one another to form a compressor housing, wherein the motor chamber and the compression chamber are not sealed off from one another, and wherein the rotor shafts of the compressor rotors extend at an angle with or transverse to a horizontal plane during normal operation of the vertical screw compressor, and wherein a pressure vessel is arranged downstream and separate from the compressor housing having an outlet valve;

stopping the vertical screw compressor in a way such that air that has been compressed is not released, wherein the pressure vessel, the compression chamber, and the motor chamber are in fluid communication and remain under a substantially constant compression pressure; and restarting the vertical screw compressor with a large start-up torque.

16. The method according to claim 15, further comprising the steps of cooling and lubricating the vertical screw compressor with a fluid, wherein the drive motor and the pair of meshed helical compressor rotors are cooled and lubricated with the same fluid.

17. The method according to claim 15, further comprising the step of hermetically closing off the inlet of the compression chamber using an inlet valve when the compressor is stopped.

18. The method according to claim 15, further comprising the step of automatically closing the outlet valve of the pressure vessel and hermetically closing an inlet pipe to the pressure vessel from the vertical screw compressor.

* * * * *